United States Patent [19]

Nishikawa

[11] Patent Number: 4,516,850

[45] Date of Patent: May 14, 1985

[54] TONER CLEANING DEVICE FOR ELECTROPHOTOGRAPHIC COPYING MACHINE

[75] Inventor: Masaji Nishikawa, Hachioji, Japan

[73] Assignee: Olympus Optical Company, Ltd., Tokyo, Japan

[21] Appl. No.: 487,060

[22] Filed: Apr. 21, 1983

[30] Foreign Application Priority Data

Jun. 11, 1982 [JP] Japan ..... 57-99347

[51] Int. Cl.[3] ..... G03G 15/08

[52] U.S. Cl. ..... 355/15; 355/3 DD

[58] Field of Search ..... 355/15, 3 R, 3 DD, 14 D

[56] References Cited

U.S. PATENT DOCUMENTS 3,552,850 1/1971 Royka et al. ..... 355/15
4,174,172 11/1979 Lane ..... 355/15
4,218,131 8/1980 Ito et al. ..... 355/15
4,218,132 8/1980 Iwai et al. ..... 355/15
4,259,003 3/1981 Mangal et al. ..... 355/15 X
4,314,756 2/1982 Amitani et al. ..... 355/15

*Primary Examiner*—A. C. Prescott
*Attorney, Agent, or Firm*—Louis Weinstein

[57] ABSTRACT

A toner cleaning unit is provided for use in an electrophotographic copying machine to remove residual toner from a photosensitive drum after the transfer of a toner image onto a copy sheet and prior to formation of another electrostatic latent image thereon. The unit comprises a cleaning blade which is disposed for selective contact with the photosensitive drum to collect any residual toner, and an intercept member disposed adjacent to the blade for intercepting any toner which might freely fall from a pile of toner defined in the region of contact between the blade and the drum. By moving the blade away from the photosensitive drum, the pile of toner may be conveyed to a developing unit as the drum rotates.

13 Claims, 10 Drawing Figures

TONER CLEANING DEVICE FOR ELECTROPHOTOGRAPHIC COPYING MACHINE

BACKGROUND OF THE INVENTION

The invention relates to a cleaning device which removes any residual toner from an electrophotographic copying machine.

In an electrophotographic copying machine, it is recognized that any residual toner which remains on a photosensitive drum without being transferred onto a copy sheet, subsequent to a transfer of a toner image thereto, must be removed by a cleaning operation, prior to the formation of a new electrostatic latent image thereon. A variety of cleaning devices have been proposed to this end, including a fur brush, a blade or a magnetic brush. In an electrophotographic copying machine including a developing unit which utilizes a dry developer as a toner to develop an electrostatic latent image formed on a photosensitive drum, it is preferred to recover any residual toner on the drum into the developing unit for re-use. Such recovery is disabled with a cleaning device which utilizes a fur brush, since a residual toner removed by the fur brush is generally trapped by a filter as it is conveyed on an airstream, produced by an air suction mechanism, to be disposed. Additionally, the arrangement is complex and bulky in size since a suction mechanism and a filter must be provided, resulting in a disadvantageous increase in the size of the entire copying machine. A cleaning device of blade type employs a blade formed from an elastic material such as urethane and which is held in contact with the photosensitive drum for the purpose of cleaning the drum. This latter arrangement simplifies the construction and reduces the size of the copier machine, and any residual toner on the drum can be collected by the blade for recovery into the developing unit for re-use. However, in the prior art practice, a toner vessel is provided to receive residual toner collected by the blade in order to prevent a free fall from the drum, and the vessel is manually discharged into the developing unit in a periodic manner. Alternatively, toner received in the toner vessel is automatically conveyed into the developing unit by separate toner conveyor means including a flexible screw or the like. In the former instance, the maintenance represents a troublesome operation while in the latter, the arrangement becomes expensive, and the toner conveyor means is complex in construction.

Where a magnetic brush is used in a cleaning device, the latter may also serve as a developing unit. In such instance, any toner that is removed can be directly carried into the developing unit, thus advantageously dispensing with the removal of the removed toner to the exterior of the copying machine, a periodic maintenance which recovers the toner into the developing unit, or a complex arragement for automatically returning the removed toner into the developing unit. In this manner, the magnetic brush cleaning device is advantageous in reducing the cost and the maintenance of the arrangement. However, when the developing unit also serves as a cleaning device, the location of the developing unit which is normally chosen, namely, intermediate a station where a latent image is formed and a transfer station to transfer a toner image, makes it impossible to effect a cleaning and a developing step simultaneously as is done in an electrophotographic arrangement which is provided with a devoted cleaning unit located intermediate the transfer station and the latent image forming station. Accordingly, where it is desired to produce a plurality of copies in succession, at least two revolutions of the photosensitive drum are required to produce a single copy. In addition, the peripheral length of the photosensitive drum must be greater than the length of copy sheets of the maximum size. Accordingly, as compared with an electrophotographic machine having a devoted cleaning unit, the machine with the combined developing and cleaning unit must be designed to operate with a higher process speed in order to achieve the same rate of producing copies. In addition, the constraint on the configuration of the photosensitive drum disadvantageously results in an increased overall size of the arrangement.

FIG. 1 is a schematic view of one exemplary electrophotographic copying machine provided in the prior art in which a combined developing and cleaning unit is used. In FIG. 1, as a copying operation is initiated, a photosensitive drum 1 begins to rotate in a direction indicated by an arrow a, and is uniformly charged by a corona charger 2. An original to be copied is placed on a movable receptacle 3 and is fed in a direction indicated by an arrow b. As the original moves, it is irradiated by an illumination lamp 4 cooperating with a reflecting mirror 5, and an optical image of the original is projected onto the drum 1 by a fiber lens array 6, thus forming an electrostatic latent image corresponding to the image of the original in receptacle 3 on the drum 1. A developing unit 7 which utilizes dry developer includes a magnetic brush roller 8, which developes the latent image with the toner, and the resulting toner image is brought into superimposed relationship with a copy sheet, which is fed from a sheet cassette 9 by a pickup roller 10 and a pair of feed rollers 11. A corona charger 12 acts to transfer the toner image onto the copy sheet. The copy sheet is separated from the drum 1 under the action of another corona charger 13 which effects a separating action. Subsequently, the copy sheet carrying the toner image is passed between a pair of fixing rollers 14 where the toner image is fixed. Subsequently, it is delivered onto a copy tray 16 by a pair of delivery rollers 15. The cleaning step which removes any residual toner from the drum 1 after the toner image has been transferred onto the copy sheet takes place by a continued rotation of the drum 1 through one revolution. Initially, the charge is removed from the drum 1 which may have any residual toner on its surface, by a uniform exposure to illumination from a neutralizer lamp 17 and any residual toner is recovered into the developing unit 7 as a result of a rubbing contact of the drum with the magnetic brush roller 8 in the developing unit 7. Subsequently, when the drum 1 from which any residual toner has been removed rotates to a position corresponding to the charger 2, another copying operation is initiated when a next original is set in position. Thus, it will be seen that it is necessary that the drum 1 rotates through two revolutions per copy where a plurality of copies are to be produced in succession. Furthermore, since the developing unit 7 performs both the developing and the cleaning operation, the peripheral length of the drum 1 must be greater than the length of copy sheet the maximum size employed in the copying machine. Because of these requirements, the peripheral speed of the drum 1 must be increased as compared with an electrophotographic copying machine having a devoted cleaning unit in order to achieve the same rate of producing copies per unit time, and accordingly a higher duty is imposed upon the chargers 2, 12, 13, the lamp 4, the developing unit 7 and the fixing rollers 14. When producing a copy of a reduced size, it is possible in an electrophotographic copying machine having a devoted cleaning unit that the forward and reverse stroke of an original receptacle or scanning optics be changed in accordance with copy size to increase the number of copies produced per unit time. However, in the arrangement shown in FIG. 1, the number of copies produced per unit time cannot be increased for copies of reduced size. It is possible to increase the number of copies produced per unit time by increasing the speed of the original receptacle and scanning optics during their reverse stroke in the arrangement having a devoted cleaning unit, but such measure cannot be taken in the arrangement of FIG. 1. Also, in the arrangement having a devoted cleaning unit, the diameter of the photosensitive drum can be reduced concomitant with a requirement that associated devices can be arranged around the drum. However, in the arrangement of FIG. 1, the drum diameter cannot be reduced below a value which provides a peripheral length corresponding to the maximum size i.e., length of copies to be produced. With respect to the cleaning function, it is necessary in the arrangement of FIG. 1 that a supplementary measure be taken as by increasing a developing bias voltage to assure a satisfactory cleaning performance when the unit aso serves as a cleaning unit.

An electrophotographic copying machine having a combined developing and cleaning unit is used in practice despite a number of drawbacks as mentioned above, for the reason that a devoted cleaning unit which is complex and which involves difficulty in maintenance can be dispensed with, while affording an advantage that any toner removed by the cleaning operation can be entirely utilized again.

SUMMARY OF THE INVENTION

It is an object of the invention to provide a toner cleaning unit for an electrophotographic copying machine which permits a sophisticated utilization of a charge retaining member such as photosensitive drum in a manner to permit any residual toner thereon to be easily and reliably recovered into a developing unit.

In accordance with the invention, any residual toner on a charge retaining member is wiped off by a cleaning blade which is disposed in contact therewith, thereby defining a toner pile on the member. Toner freely falling down from the pile is received by an intercept member to be deposited on the charge retaining member again. By moving the blade away from the retaining member, the toner pile formed is allowed to be conveyed into a developing unit for recovery as the retaining member rotates. In this manner, any residual toner on the charge retaining member is entirely recovered into the developing unit in a facilitated and reliable manner, with a simple arrangement. In this manner, an electrophotographic copying machine can be provided which avoids the need for maintenance for the purpose of toner processing during the cleaning operation, as experienced in the prior art. By forming the intercept member of an elastic member and selectivey causing it to be displaced in a direction to be brought into contact with the charge retaining member, a block of toner intercepted by the intercept member can be effectively pulverized. A more effective pulverization can be achieved if the side of the intercept member which faces the charge retaining member is gigged or napped. The construction can be simplified by holding the cleaning blade and the intercept member in an integral manner. The provision of the intercept member avoids the need for a separate provision of another intercept member which is designed to prevent a free fall of the formed toner pile under gravity. The intercept member pulverizes the toner pile to facilitate its movement away from the charge retaining member and the pulverized toner is effectively recovered by the developing unit as the retaining member rotates, thus minimizing the loss of toner. No separate recovery means is required, thus simplifying the construction.

DESCRIPTION OF THE PREFERRED EMBODIMENTS

Figure 1:
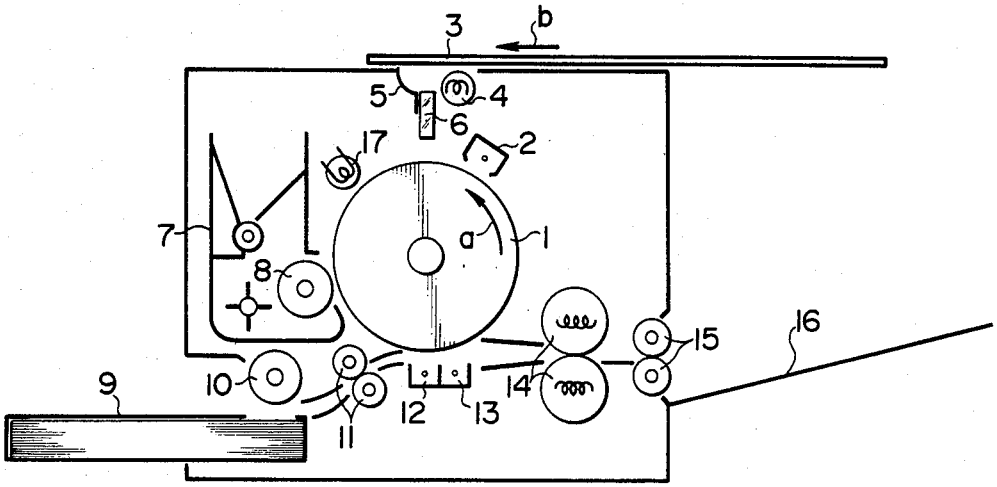
FIG. 1 (PRIOR ART)
FIG. 1 is a schematic view of one example of a conventional electrophotographic copying machine in which a developing unit also serves as a cleaning unit.
Figure 2:
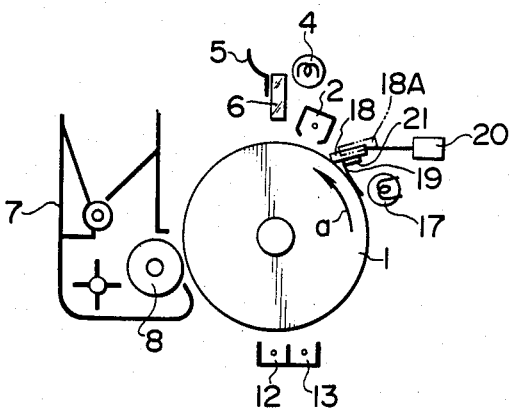
FIG. 2 is a schematic view of a cleaning unit according to one embodiment of the invention.

Referring to FIG. 2, there is shown one form of electrophotographic copying machine incorporating a toner cleaning unit according to the invention in schematic view. It should be understood that parts corresponding to those shown in FIG. 1 are designated by like reference numerals. The arrangement shown in FIG. 2 is essentially distinguished from the arrangement of FIG. 1 in the provision of a cleaning blade 18 formed of an elastic material such as urethane and disposed along the periphery of the drum at a point downstream of a toner image transfer station including the transfer charger 12 and the separation charger 13 and upstream of the charger 2 so as to be selectively brought into contact with the photosensitive drum 1 for collecting any residual toner thereon, and a strip-shaped intercept member 19 for receiving or intercepting any toner which may freely fall down from a pile of toner collected by the blade 18. While it is not essential, a neutralizer lamp 17 or an A.C. corona neutralizer may be preferably provided upstream of the blade 18. The blade 18 is associated with blade drive means 20 which is arranged to cause the 18 to be normally urged into contact with the drum 1, as indicated in solid line, during a copying operation, and to be once retracted to a position 18A automatically so as to be spaced from the drum 1, at a point in time which is intermediate the completion of forming a latent image on a preceding copy and before the initiation of forming a latent on a succeeding copy and then again returned to its solid line position where it is maintained in contact with the drum 1. The intercept member 19 is preferably formed of a material having an elasticity such as a sheet of plastic material, for example, polyester film, or a metal sheet, for example, a sheet of stainless steel, and is carried by a holding member 21 to be coextensive with the blade 18 in contact with or in proximity to the drum 1 on the upstream side of and adjacent to the blade 18.

Figure 3A:
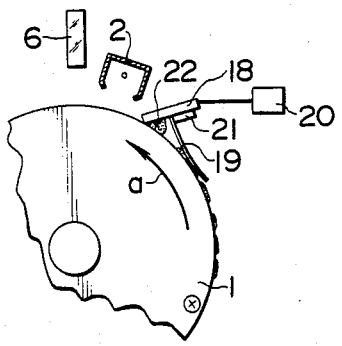
FIGS. 3A to 3C are enlarged views illustrating the operation of the cleaning unit shown in FIG. 2.
Figure 3B:
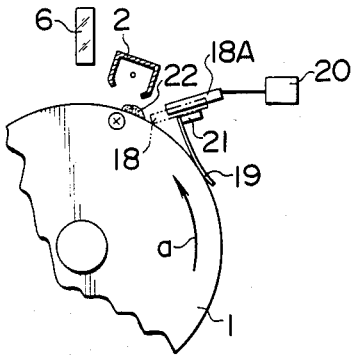
Figure 3C:
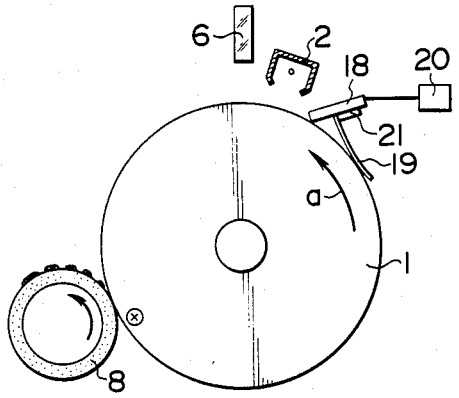

FIGS. 3A to 3C illustrate the operation of the blade 18. In these Figures, an encircled X mark represents the trailing end of a region on the drum 1 which must be cleaned. When the blade 18 is brought into contact with the drum 1 as indicated in FIG. 3A, any residual toner on the drum 1 is collected by the blade 18 as the drum 1 rotates in a direction indicated by an arrow a, thereby defining a pile 22 of toner on the free end of the blade. When the blade 18 is retracted from its phantom line position ( FIG. 3B) to its solid line position 18A after a cleaning of the region has been terminated, the pile 22 remains on the drum 1 and is conveyed toward the developing unit as the drum rotates, and is recovered by the magnetic brush roller 8 into the developing unit 7, as indicated in FIG. 3C. In FIG. 3C, black solid dots represent toner which previously defined a pile and which is conveyed on the drum.

The toner pile 22 which is conveyed on the drum 1 to the developing unit 7 forms a thick layer and has been formed after the blade 18 has scraped it from the drum 1, and hence there is no electrostatic attraction between the toner and the drum 1. In addition, the pile 22 contains a stratum of air which is produced during the sliding action of the blade 18. Accordingly, the adherence of the pile to the drum is weak enough to permit its removal in a facilitated manner. This brings forth the advantage that no additional aid or means such as the application of an increased developing bias voltage is dispensed with when recovering the toner 22 from the drum 1 by means of the brush roller 8.

While there is no limitation in principle on the construction of a developing unit and a dry developer which are used in the present invention, an arrangement which provides relatively increased spacing between the photosensitive drum and a sleeve which holds and conveys a developer, such as a combination of dry developer with either one of a two magnetic component developing system, a single magnetic component developing system or a fur brush developing system, is preferably used without causing any additional problem. Means which is used in the developing unit to recover the removed toner is not limited to the magnetic brush roller 8 which is disposed in contact with the drum as indicated in FIG. 3C, but any alternative mechanical or physical means may be used. By way of example, a scraper may be disposed upstream of the developing unit 7 and having a free end which is disposed in contact with or in close proximity to the drum 1, with the pile 22 recovered by the scraper being introduced into a toner hopper or the developer contained in the developing unit 7.

Figure 4:
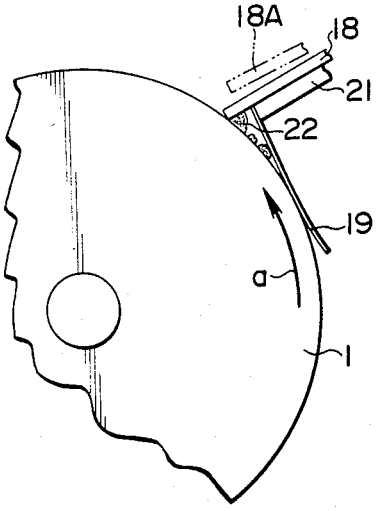
FIG. 4 is a fragmentary enlarged view of the cleaning unit shown in FIG. 2.

Referring to FIGS. 3A to 3C, the majority of toner pile 22 which is scraped and collected by the cleaning blade 18 will be conveyed on the drum 1 toward the developing unit 7 as the blade 18 moves away from the drum. However, a small portion of the toner, in particular, that portion which has been agglomerated as it is collected by the blade 18 exhibits as adherence to the drum 1 or the blade 18, which is overcome by the gravitational force to fall down from the pile 22. In a conventional cleaning unit of blade type, such free fall of the toner is utilized to collect the residual toner. To this end, a toner vessel must be provided in order to receive the toner, resulting in a troublesome maintenance work. By contrast, in accordance with the invention, the intercept member 19 is disposed adjacent to and on the upstream side of the blade 18 so as to be coextensive with the blade while being positioned in contact with or in proximity to the drum 1, as indicated by an enlarged view of FIG. 4. Consequently, any toner which falls down from the pile 22 is intercepted in a substantially triangular region defined by the intercept member 19 and the drum 1, and cannot move down freely. The toner which is intercepted by the intercept member 19 is pulverized again as the drum 1 rotates to be deposited thereon and conveyed thereby, and thus is again collected by the blade 18 to define the pile 22. As the blade 18 moves away from the drum, the pile is conveyed on the drum 1 into the developing unit 7 for recovery.

It will thus be seen that the intercept member 19 has the dual function of preventing a free fall of toner that has been collected by the cleaning blade 18 and of preventing any contamination of the electrophotographic copying machine as a result of diffusion of a toner cloud which is produced when the blade 18 moves away or toward the drum 1.

In the embodiment described above, the holding member 21 which carries the intercept member 19 may be disposed in a stationary manner. Alternatively, it may be disposed so as to be movable in a manner similar to the blade 18, so as to move in a direction to allow the intercept member 19 to be brought into contact with the drum 1. Where a movable arrangement is employed, the blade 18 and the holding member 21 may be independently movable or the holding member may be integrally movable with the blade 18 by forming the holding member by a portion of the blade 18 itself or a part of a member which holds the blade. Where the holding member 21 is disposed to be movable, it is necessary that the intercept member 19 has sufficient flexibility and be maintained in contact with the drum 1 while avoiding any damage caused to the drum surface which might occur if the movement of the holding member 21 causes the intercept member 19 to abut against the drum under undue pressure. When the intercept member 19 is displaced in a flexure mode in a direction to move toward or away from the drum 1, any agglomeration of toner intercepted by the intercept member 19 can be positively collapsed, thereby facilitating a deposition of the toner on the drum.

Figure 5A:
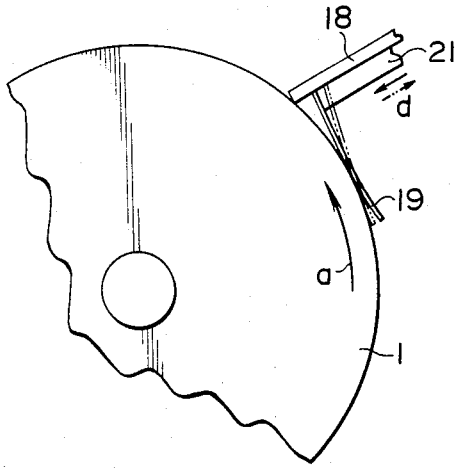
FIGS. 5A to 5C are fragmentary enlarged views of cleaning units according to other embodiments of the invention.
Figure 5B:
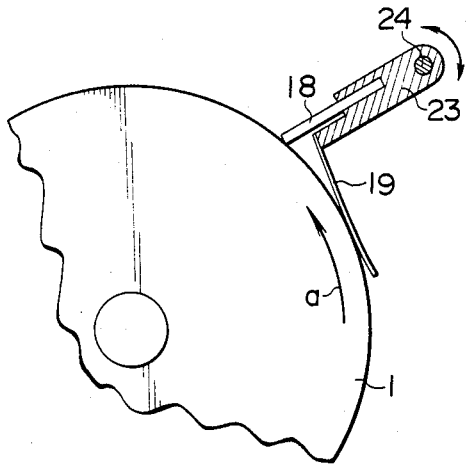
Figure 5C:
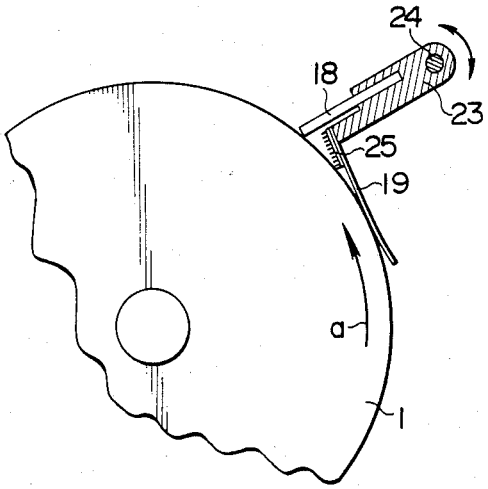

FIGS. 5A to 5C show other embodiments of the invention in which the intercept member 19 is adapted to be displaced in a flexure mode. FIG. 5A shows that the holding member 21 is constructed to be substantially linearly movable in a direction indicated by an arrow d independently from the blade 18 so that its selective movement in the forward or the reverse direction causes the intercept member 19 to be displaced in a flexure mode between positions respectively shown in solid and phantom lines, thereby pulverizing any agglomeration of toner that is intercepted by the intercept member 19. The holding member 21 may be moved at any desired timing. By way of example, such timing may be synchronized with a movement of the blade 18, whereby a control circuit and associated mechanism can be greatly simplified. In FIG. 5B, both the blade 18 and the intercept member 19 are carried by a common holding member 23, which is pivotally mounted on a pin 24 so as to cause an integral displacement of the blade 18 and the intercept member 19. The blade 18 is in contact with the drum 1 in FIG. 5B, but as the holding member 23 moves clockwise, the blade 18 can be moved away from the drum 1 while the intercept member 19 can be displaced in a flexure mode in a direction toward the drum 1, thus crushing any agglomeration of toner for pulverization. FIG. 5C shows a modification of the arrangement shown in FIG. 5B in that a portion of the intercept member 19 which is adapted to bear against the drum 1 and which also extends along the blade 18 is provided with a napped material 25 on its surface which faces the drum 1. The napped material 25 may be a napped cloth comprising a substrate fabric in which rigid fibers, for example, acrylic fibers are implanted. The napped material 25 moves toward the drum 1 in response to a rocking motion of the holding member 23, thereby piercing into the agglomeration of toner to pulverize it. The napped material 25 may also be effectively utilized in the embodiment shown in FIG. 5A.

Figure 6:
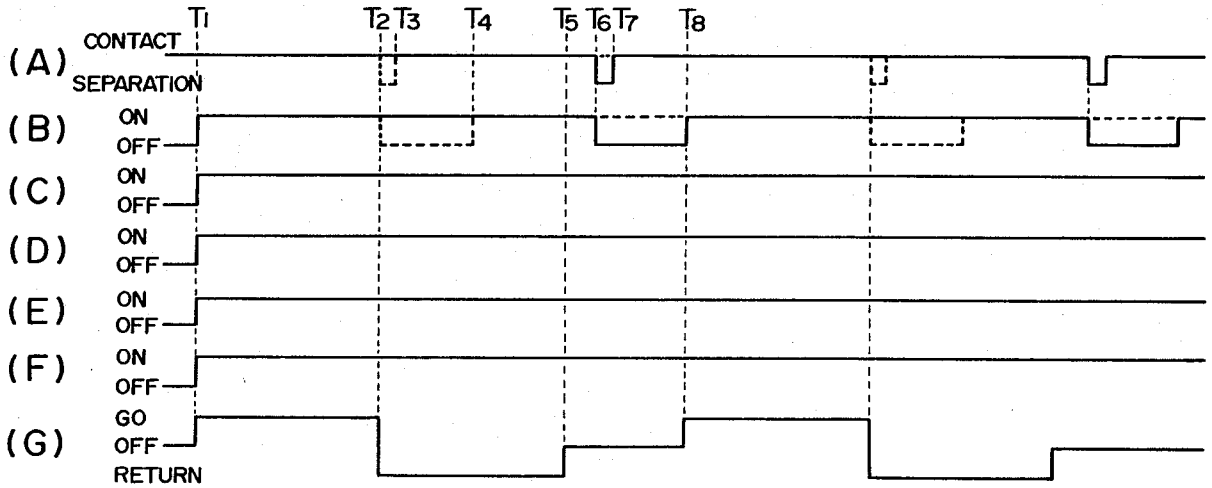
FIG. 6 is a timing chart illustrating the timing of the operation of various parts of the cleaning unit shown in FIG. 2.

FIG. 6 is a timing chart showing an exemplary sequence of operation when copies are to be produced in succession with the electrophotographic copying machine shown in FIG. 2. In this example, the illumination lamp 4, the developing unit 7, the transfer station including the transfer charger 12 and the separation charger 13 and the neutralizer lamp 17 are maintained in operation during consecutive copying operation, as indicated in FIGS. 6C, D, E and F, respectively. The operation of the cleaning blade 18, the charger 2 and the original receptacle or the scanning optics is controlled in connection with a consecutive copying operation, in a manner as illustrated in FIGS. 6A, B and G, respectively.

The operation will now be described with reference to FIGS. 2 and 3. At time $T_1$, the copying operation is initiated, whereupon all the units and devices are activated as shown in FIGS. 6A to G. At time $T_2$, either the original receptacle or the scanning optics changes from its forward to its reverse stroke after having moved through a given distance, and comes to a stop at time $T_5$. It starts at time $T_8$. This means that the formation of a latent image is completed at time $T_2$ and is re-initiated at time $T_8$. The cleaning blade 18 is once removed from the photosensitive drum 1 when a latent image is not being formed, that is, at an arbitrary point during an interval from time $T_2$ to time $T_8$, as shown in FIG. 6A, allowing the pile 22 of any residual toner which is collected by the blade 18 to be conveyed into the developing unit 7 for recovery through the rotation of the drum 1. More strictly, the blade 18 is moved away from the drum 1 during a time region from a time when an area on the drum 1 which corresponds to the trailing end of the preceding image formed moves past the blade 18 to a time when an area on the drum 1 corresponding to the leading end of the next image to be formed reaches the blade 18. The blade 18 is moved away from the drum 1 at an arbitrary point and over a time interval during such time region. Two examples of such time interval is illustrated in FIG. 6A by a time interval $T_2$–$T_3$ or $T_6$–$T_7$.

The charger 2 is deactivated at least for a period which is required for the pile 22 collected by the blade 18 to move past the region of the charger 2. For this reason, in the present example, the charger 2 is deactivated during a time interval $T_2$–$T_4$ or $T_6$–$T_8$, as shown in FIG. 6B, in a manner corresponding to the time interval $T_2$–$T_3$ or $T_6$–$T_7$ during which the blade 18 is removed from the drum, as shown in FIG. 6A. When the charger 2 is deactivated at least during a period required for the pile 22 to move past the charger 2, any undesirable charging of the pile 22 is avoided, thus effectively preventing any degradation in the image quality or developer which is attributable to the charging of the pile 22.

In the example shown in FIG. 6, if the intercept member 19 is arranged as shown in FIG. 5B or FIG. 5C, it is assured that the intercept member 19 will be displaced in a flexure mode whenever the blade 18 moves away from the drum 1. Alternatively, if the blade 18 and the intercept member 19 are arranged to be displaceable independently from each other as in an arrangement shown in FIG. 5A, the holding member 21 may be operated at an arbitrary timing or in conjunction with the operation of any device such as the blade 18, the charger 2 or the scanning optics.

What is claimed is:

1. A toner cleaning unit for an electrophotographic copying machine including a charge retaining member on which an electrostatic latent image is formed and is converted into a toner image by means of a developing unit which utilizes a dry developer, the resulting toner image being transferred onto a record sheet, the cleaning unit being operative to remove any residual toner from the charge retaining member after the transfer of the toner image; comprising:

a movable cleaning blade disposed for selective contact with the charge retaining member to collect any toner which remains thereon after the transfer of the toner image, means for selectively moving said cleaning blade towards and away from the charge retaining member, and an intercept member disposed adjacent to the cleaning blade and upstream thereof as viewed in the direction of rotation of the charge retaining member and in contact with or in proximity to the latter, the intercept member being coextensive with the cleaning blade, a toner pile being formed in the region of contact between the blade and the charge retaining member as the blade is disposed in contact with the retaining member by said blade moving means, the intercept member intercepting any toner which might freely fall down from the pile when the cleaning blade is moved away from the charge retaining member by said blade moving means to permit the toner pile to be conveyed into the developing unit by the charge retaining member as the charge retaining member rotates.

2. A toner cleaning unit according to claim 1 in which the cleaning blade is formed of an elastic material.

3. A toner cleaning unit according to claim 1 in which a portion of the intercept member which is coextensive with the cleaning blade is arranged to be selectively movable in a direction toward or away from the charge retaining member.

4. A toner cleaning unit according to claim 1 in which the intercept member is carried so as to be displaceable in an integral manner with the cleaning blade.

5. A toner cleaning unit according to claim 3 in which the intercept member is formed by an elastic strip in the form of a plastic sheet such as polyester film or a metal sheet such as stainless steel sheet.

6. A toner cleaning unit according to claim 3 in which the surface of the intercept member which faces the charge retaining member is napped in a region coextensive with the cleaning blade.

7. A toner cleaning unit according to claim 6 in which the intercept member is napped by applying a napped cloth comprising a substrate fabric in which rigid acrylic fibers are implanted.

8. A cleaning unit according to claim 2 wherein the elastic material is a plastic material.

9. A cleaning unit according to claim 8 wherein said plastic material is urethane.

10. A toner cleaning unit according to claim 4 in which the intercept member is formed by an elastic strip in the form of a plastic sheet such as polyester film or a metal sheet such as stainless steel sheet.

11. A toner cleaning unit according to claim 4 in which the surface of the intercept member which faces the charge retaining member is napped in a region coextensive with the cleaning blade.

12. A toner cleaning unit according to claim 11 in which the intercept member is napped by applying a napped cloth comprising a substrate fabric in which rigid acrylic fibers are implanted.

13. A toner cleaning unit according to claim 1 in which the intercept member is maintained in sliding engagement with the charge retaining member even when the cleaning blade is moved away from the charge retaining member by said blade moving means to prevent toner pile collected between the cleaning blade and the intercept member from falling downwardly and away from the charge retaining member.

* * * * *

UNITED STATES PATENT AND TRADEMARK OFFICE

CERTIFICATE OF CORRECTION

PATENT NO. : 4,516,850

DATED : May 14, 1985

INVENTOR(S) : Masaji Nishikawa

It is certified that error appears in the above-identified patent and that said Letters Patent is hereby corrected as shown below:

Column 2, line 63, change "copy sheet the maximum size" to --the maximum size copy sheet--.

Column 3, line 23, change "i.e., length" to --(i.e., length)--.

Column 3, line 28, change "aso" to --also--.

Column 3, line 62, change "selectivey" to --selectively--.

Column 4, line 55, before "18" insert --blade--.

Signed and Sealed this

*Fifteenth* Day of *October 1985*

[SEAL]

*Attest:*

*Attesting Officer*

DONALD J. QUIGG

*Commissioner of Patents and Trademarks—Designate*